US009476128B2

(12) United States Patent
Uemura et al.

(10) Patent No.: US 9,476,128 B2
(45) Date of Patent: Oct. 25, 2016

(54) METHOD OF CLEANING STEEL SHEET AND CONTINUOUS CLEANING SYSTEM OF STEEL SHEET

(75) Inventors: Kenichi Uemura, Tokyo (JP); Tadashi Sakon, Tokyo (JP); Eiichi Kuboyama, Tokyo (JP); Daisuke Sawada, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 12/451,231

(22) PCT Filed: Apr. 30, 2008

(86) PCT No.: PCT/JP2008/058597

§ 371 (c)(1),
(2), (4) Date: Oct. 30, 2009

(87) PCT Pub. No.: WO2008/136537

PCT Pub. Date: Nov. 13, 2008

(65) Prior Publication Data

US 2010/0095980 A1 Apr. 22, 2010

(30) Foreign Application Priority Data

May 1, 2007 (JP) ..... 2007-120652

(51) Int. Cl.

| | |
|---|---|
| ***C23G 1/08*** | (2006.01) |
| ***B08B 3/02*** | (2006.01) |
| ***B08B 3/12*** | (2006.01) |

(Continued)

(52) U.S. Cl.

CPC ..... *C23G 1/08* (2013.01); *B08B 3/022* (2013.01); *B08B 3/12* (2013.01); *C23G 1/19* (2013.01); *C23G 3/02* (2013.01);

(Continued)

(58) Field of Classification Search

CPC ..... C23G 3/023; C23G 3/024; C23G 1/08
See application file for complete search history.

(56) References Cited

U.S. PATENT DOCUMENTS 5,409,594 A 4/1995 Al-Jiboory et al.
5,472,579 A * 12/1995 Mabuchi et al. ..... 205/709

(Continued)

FOREIGN PATENT DOCUMENTS

JP 64-10312 1/1989
JP 4-341590 11/1992

(Continued)

OTHER PUBLICATIONS

Machine Translation JP 05033175A.*

(Continued)

*Primary Examiner* — Michael Kornakov
*Assistant Examiner* — Ryan Coleman
(74) *Attorney, Agent, or Firm* — Birch, Stewart, Kolasch & Birch, LLP

(57) ABSTRACT

The present invention provides a method of cleaning steel sheet, said method of cleaning steel sheet feeding a cleaning solution activated by ultrasonic waves of a frequency of 0.8 MHz to 3 MHz to a surface of steel sheet at an angle inclined by 1 to 80° with respect to a line perpendicular to the surface of the steel sheet in a direction opposite to the running direction, thereby enabling megasonic waves to be applied to cleaning of running steel sheet and improving the cleaning effect and cleaning speed, and a continuous cleaning system of steel sheet.

5 Claims, 8 Drawing Sheets

(51) Int. Cl.

| | |
|---|---|
| ***C23G 1/19*** | (2006.01) |
| ***C23G 3/02*** | (2006.01) |
| *B21B 45/02* | (2006.01) |
| *B21B 45/04* | (2006.01) |

(52) U.S. Cl.
CPC ... *B08B 2203/0288* (2013.01); *B21B 45/0275* (2013.01); *B21B 45/04* (2013.01)

(56) References Cited

U.S. PATENT DOCUMENTS

| | | | | |
|---|---|---|---|---|
| 8,038,800 | B2 | 10/2011 | Rossa et al. | |
| 2002/0029788 | A1* | 3/2002 | Verhaverbeke et al. | 134/1.3 |
| 2002/0134400 | A1* | 9/2002 | Schwarze et al. | 134/1 |
| 2004/0173293 | A1* | 9/2004 | Jung | B24B 7/13 148/527 |
| 2006/0021642 | A1* | 2/2006 | Sliwa et al. | 134/184 |

FOREIGN PATENT DOCUMENTS

| | | | |
|---|---|---|---|
| JP | 05-033175 | | 2/1993 |
| JP | 05033175 | A * | 2/1993 |
| JP | 05-078870 | | 3/1993 |
| JP | 05-125573 | | 5/1993 |
| JP | 08-044074 | | 2/1996 |
| JP | 09-171986 | | 6/1997 |
| JP | 10-172948 | | 6/1998 |
| JP | 2000-256886 | | 9/2000 |
| JP | 2000-290788 | | 10/2000 |
| JP | 2003-313688 | | 11/2003 |
| JP | 2003-533591 | | 11/2003 |
| JP | 2006-263720 | | 10/2006 |
| WO | 2007/017223 | | 2/2007 |

OTHER PUBLICATIONS

International Search Report dated Jun. 24, 2008 issued in corresponding PCT Application No. PCT/JP2008/058597.

Extended European Search Report dated Oct. 21, 2013 issued in corresponding EP Application No. 08 75 2483.

* cited by examiner

METHOD OF CLEANING STEEL SHEET AND CONTINUOUS CLEANING SYSTEM OF STEEL SHEET

This application is a national stage application of International Application No. PCT/JP2008/058597, filed 30 Apr. 2008, which claims priority to Japanese Application No. 2007-120652, filed 1 May 2007, which is incorporated by reference in its entirety.

TECHNICAL FIELD

The present invention relates to a method of cleaning running steel sheet and a continuous cleaning system of steel sheet, more particularly relates to a method of efficiently removing oxidized scale formed in the process of production of steel sheet.

BACKGROUND ART

In the process of production of steel sheet, the surface of the steel sheet is cleaned for various purposes. For example, cleaning of the steel sheet before plating or painting, removal of oxidized scale by pickling of hot rolled steel sheet (descaling), etc. may be mentioned.

The promotion or increase of the efficiency of such cleaning, the improvement of the cleaning power, etc. are largely achieved by the design of the cleaning solution, but as one further method for assisting cleaning at the time of cleaning, there is the method of applying 20 to 100 kHz ultrasonic waves (Japanese Patent Publication (A) No. 2003-313688, Japanese Patent Publication (A) No. 2000-256886, and Japanese Patent Publication (A) No. 5-125573).

If applying ultrasonic waves in the cleaning solution, a cavitation phenomenon occurs at the surface of the steel sheet, whereby the cleaning effect is promoted. That is, due to the ultrasonic waves, the pressure locally drops in the cleaning solution and becomes lower than the vapor pressure, vapor is generated, or the dissolved gases expand resulting in the rapid formation of small bubbles and cavitation and rapid breakdown, whereby an impact is given while promoting the chemical reaction of the cleaning so as to thereby promote the cleaning effect. Therefore, application of ultrasonic waves is also effective for descaling and pickling of hot rolled steel sheet (Japanese Patent Publication (A) No. 2000-256886).

For the descaling process, a pickling solution comprised of sulfuric acid, hydrochloric acid, nitric acid, fluoric acid, etc. alone or in a mixture of several types is used. To increase the pickling speed of the above pickling solution, the practice has been to increase the acid concentration and raise the pickling temperature etc., but this has minus aspects such as the increase in costs of the chemicals and energy, the orange peel skin of the surface of the steel material after pickling, etc., so there are limits to the improvement of the pickling speed. Therefore, ultrasonic waves are being used together.

However, reduction of the cost of production of steel sheet and improvement of the quality of steel sheet are desired. For cleaning or descaling steel sheet as well, further improvement of the cleaning efficiency and improvement of the cleanliness of the surface of the steel sheet are necessary.

On the other hand, in the fields of semiconductor and electronic devices, as described in Japanese Patent Publication (A) No. 10-172948, the practice has been to clean a wafer for semiconductor while applying 0.8 MHz or more frequency ultrasonic waves (megasonic waves) to the cleaning solution so as to improve its ability to remove foreign matter. Japanese Patent Publication (A) No. 10-172948 discloses a batch-cleaning method of dipping a wafer in a cleaning tank and applying megasonic waves from the bottom of the cleaning tank.

Further, Japanese Patent Publication (A) No. 8-44074 discloses, as a method of efficiently removing a resist in a process of production of a color filter for a liquid crystal display, the method of feeding a curtain-flowing developing solution activated by megasonic waves to the exposed resist.

Compared with 20 to 100 kHz ultrasonic waves (so-called conventional ultrasonic waves), megasonic waves are highly directional, so the surface of the object being cleaned can be efficiently cleaned, the solution molecules are easily activated, and the reaction promoting effect is large.

Therefore, not only in the semiconductor field, Japanese Patent Publication (A) No. 2003-533591 discloses a descaling method using a 500 to 3000 kHz ultrasonic wave source for cleaning rolled copper bars as well.

DISCLOSURE OF THE INVENTION

In the above way, megasonic waves very effectively improve the cleaning power during cleaning, so if using megasonic waves instead of ultrasonic waves conventionally used for cleaning steel sheet, it is probably possible to more effectively clean the steel sheet and improve the pickling speed.

However, in the above-mentioned fields of semiconductor and electronic devices, the objects being cleaned differ, the degree of dirtiness or level of cleanliness greatly differ, and the speed of movement of the object being cleaned, the size of the facility, and other process conditions also greatly differ, so megasonic waves are not being used for continuous cleaning of running steel sheet.

One of the reasons is that there is a problem of the maintainability of the facilities. That is, if placing a megasonic generator such as in Japanese Patent Publication (A) No. 10-172948 in a cleaning bath of a cleaning line of steel sheet in the same way as an ultrasonic generator such as in Japanese Patent Publication (A) No. 2003-313688, Japanese Patent Publication (A) No. 2000-256886, and Japanese Patent Publication (A) No. 5-125573, the megasonic waves and the cleaning solution cause severe corrosion of the container and cables of the megasonic generator thereby preventing long term use. In particular, said corrosion becomes more remarkable on a pickling line.

Japanese Patent Publication (A) No. 2003-533591 discloses the method of using ultrasonic waves for descaling in cleaning of rolled copper bars and describes that the frequency of the ultrasonic waves able to be used may be 20 to 100 kHz, 100 to 500 kHz, and 500 to 3000 kHz.

However, with bar shaped rolled materials, the cleaning bath is small and the ultrasonic generator can be attached at the outside of the cleaning bath and the object being cleaned is small, so even if applying ultrasonic waves from the outside of the cleaning bath, the effect is obtained; etc., so 500 to 3000 kHz megasonic waves may also be used.

However, even with the above method of use, while there is no problem at 20 to 500 kHz, at 500 to 3000 kHz, there is severe corrosion of the container material of the cleaning bath contacting the generator, so realistically long term use cannot be withstood.

Further, as the method of not installing a ultrasonic generator in the cleaning solution of the steel sheet, the method of using the cleaning solution for steel sheet instead of the developing solution for photographic film described in Japanese Patent Publication (A) No. 8-44074 and feeding a curtain-flowing cleaning solution activated by megasonic waves to the surface of the steel sheet may be considered.

However, in Japanese Patent Publication (A) No. 8-44074, the object being cleaned is stationary. When cleaning running steel sheet, the object being cleaned is moving, so there is the problem that effective cleaning is not possible even if simply feeding a curtain-flowing cleaning solution activated by megasonic waves to the surface of the steel sheet as in Japanese Patent Publication (A) No. 8-44074.

Further, there is the problem that the fed cleaning solution is splattered due to the running steel sheet and promotes corrosion of the ultrasonic generator or cables etc. or causes deterioration of the cleaning environment.

On the other hand, as the current cleaning solution of steel sheet, hydrochloric acid, sulfuric acid, etc. is often used. When removing oxidized scale, bubbles are formed in the pickling tank due to the reaction between the steel sheet and acid and these bubbles lower the propagation of the ultrasonic waves, so there is the problem that when using so-called low frequency ultrasonic waves (20 to 500 kHz or so) in the pickling tank, the effect of the ultrasonic waves drops.

Therefore, depending on production conditions of the steel sheet, particularly when oxidized scale is strongly deposited, even if jointly using the conventional ultrasonic waves, there are the problems that not only does the descaling become insufficient, but also, with the existing cleaning method using pickling tanks, the insoluble matter comprised of the once removed oxidized scale and other ingredients redeposits on the surface of the steel sheet when the cleaning solution is an acidic solution.

The present invention was made in consideration of the above circumstances and has as its object the provision of a method of cleaning steel sheet and a continuous cleaning system of steel sheet applying megasonic waves to the cleaning of running steel sheet and enabling stable improvement of the cleaning effect and cleaning speed.

Further, it has as its object the provision of a method of cleaning steel sheet and a continuous cleaning system of steel sheet applying megasonic waves to enable effective removal of the oxidized scale formed in the process of production of steel sheet.

The inventors intensively studied the means for solving the above problems and as a result discovered that the method of spraying a cleaning solution activated by megasonic waves to the surface of steel sheet running at a specific angle enables corrosion of the ultrasonic generator or cables eta. to be avoided and furthermore enables a striking improvement in the cleaning power. That is, the gist of the present invention is as follows:

(1) A method of cleaning steel sheet, said method of cleaning steel sheet characterized by feeding a cleaning solution activated by ultrasonic waves of a frequency of 0.8 MHz to 3 MHz to a surface of steel sheet at an angle inclined by 1 to 80° with respect to a line perpendicular to the surface of the steel sheet in a direction opposite to the running direction.

(2) A method of cleaning steel sheet as set forth in (1), characterized in that said cleaning solution is fed to the surface of the steel sheet by a shower system or a curtain flow system.

(3) A method of cleaning steel sheet as set forth in (1) and (2), characterized in that said cleaning solution is a pickling solution.

(4) A method of cleaning steel sheet as set forth in (1) and (2), characterized in that said steel sheet is hot rolled steel sheet, said cleaning solution is a pickling solution, and oxidized scale of hot rolled steel sheet is removed.

(5) A continuous cleaning system of steel sheet provided with at least an uncoiler, a cleaning solution feeder, and a coiler, said continuous cleaning system of steel sheet characterized in that said cleaning solution feeder has at least a storage part provided with an inlet of the cleaning solution and an outlet of the cleaning solution feeding a cleaning solution activated by ultrasonic waves by a shower system or a curtain flow system at an angle inclined by 1 to 80° with respect to a line perpendicular to the surface of the steel sheet in an opposite direction to the running direction and a ultrasonic generator applying a ultrasonic wave of a frequency of 0.8 to 3 MHz to the cleaning solution of the storage part.

(6) A continuous cleaning system of steel sheet as set forth in (5), characterized by being further provided with a means for flushing dried air or inert gas through a ultrasonic generator part in which said ultrasonic generator is housed.

BEST MODE FOR CARRYING OUT THE INVENTION

Below, the present invention will be explained in detail.

The inventors discovered that by feeding a cleaning solution activated by ultrasonic waves of a frequency of 0.8 MHz to 3 MHz (megasonic waves) by a shower system or curtain flow system to the surface of the running steel sheet by a feed angle of the cleaning solution inclined by 1 to 80° with respect to the line vertical to the surface of the steel sheet opposite to the running direction (the spraying direction becomes the running direction of the steel sheet), it is possible to effectively clean the surface of the steel sheet compared with cleaning using 20 to 100 kHz ultrasonic waves (conventional ultrasonic waves) and discovered that this is also effective for descaling.

Figure 1:
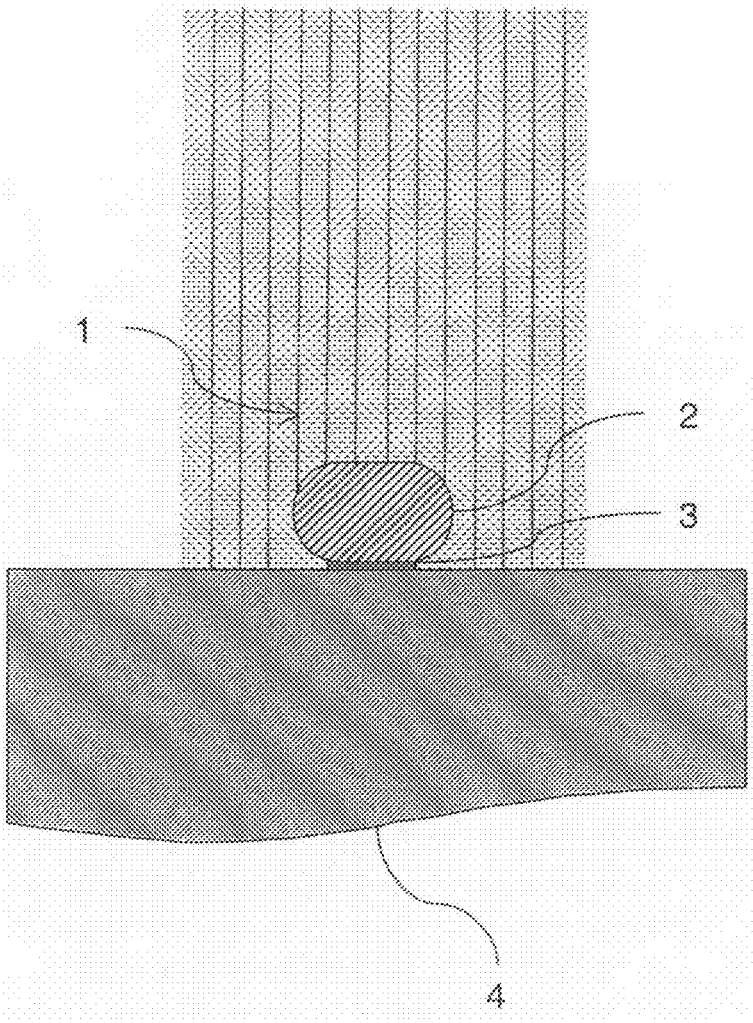
FIG. 1 is a schematic view showing the state of the case of feeding a cleaning solution activated by megasonic waves vertically to the surface of steel sheet.

The reason said cleaning effect was improved is believed to be as follows. As shown in FIG. 1, even if feeding a cleaning solution activated by megasonic waves 1 vertical to the cleaned object, that is, the steel sheet 4, similar to Japanese Patent Publication (A) No. 8-44074, since megasonic waves are higher directional than the conventional ultrasonic waves, the deposits and scale 2 form shading preventing the megasonic waves from effectively striking the bonding interfaces between the deposits and scale 2 and the surface of the steel sheet, so the cleaning effect is not improved.

Figure 2:
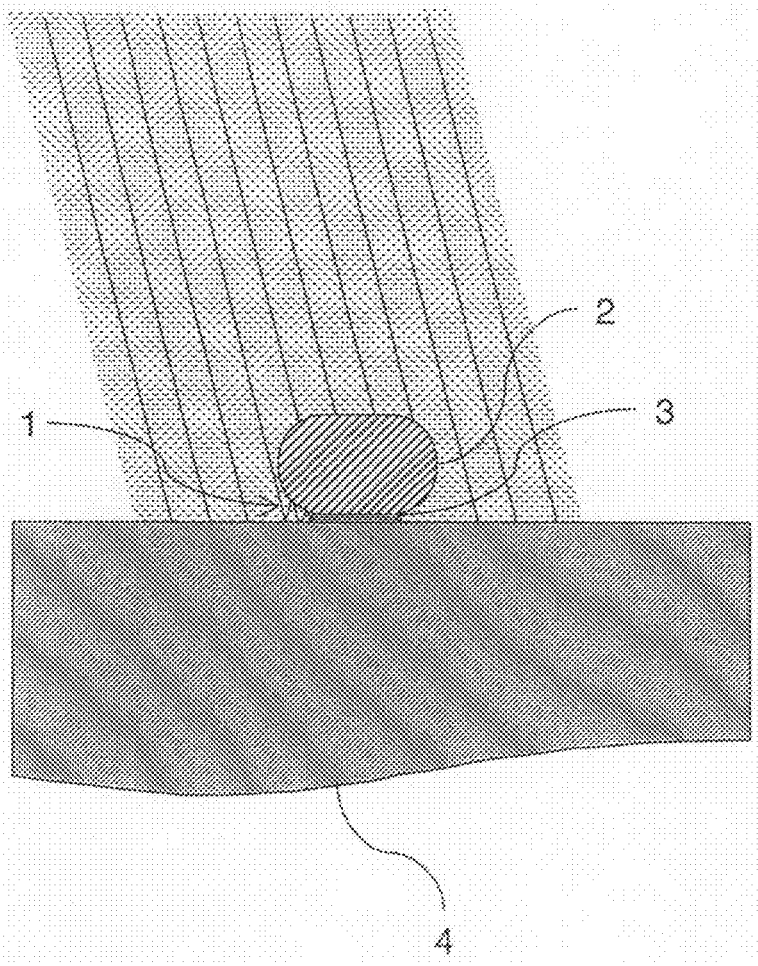
FIG. 2 is a schematic view showing the state of feeding a cleaning solution activated by megasonic waves while slanted with respect to the steel sheet surface.

However, as shown in FIG. 2, by inclining the angle of irradiation of the megasonic waves, the ratio of the megasonic waves striking the bonding interface 3 of the deposits or scale 2 with the steel sheet surface is increased and the cleaning effect is improved.

Figure 3:
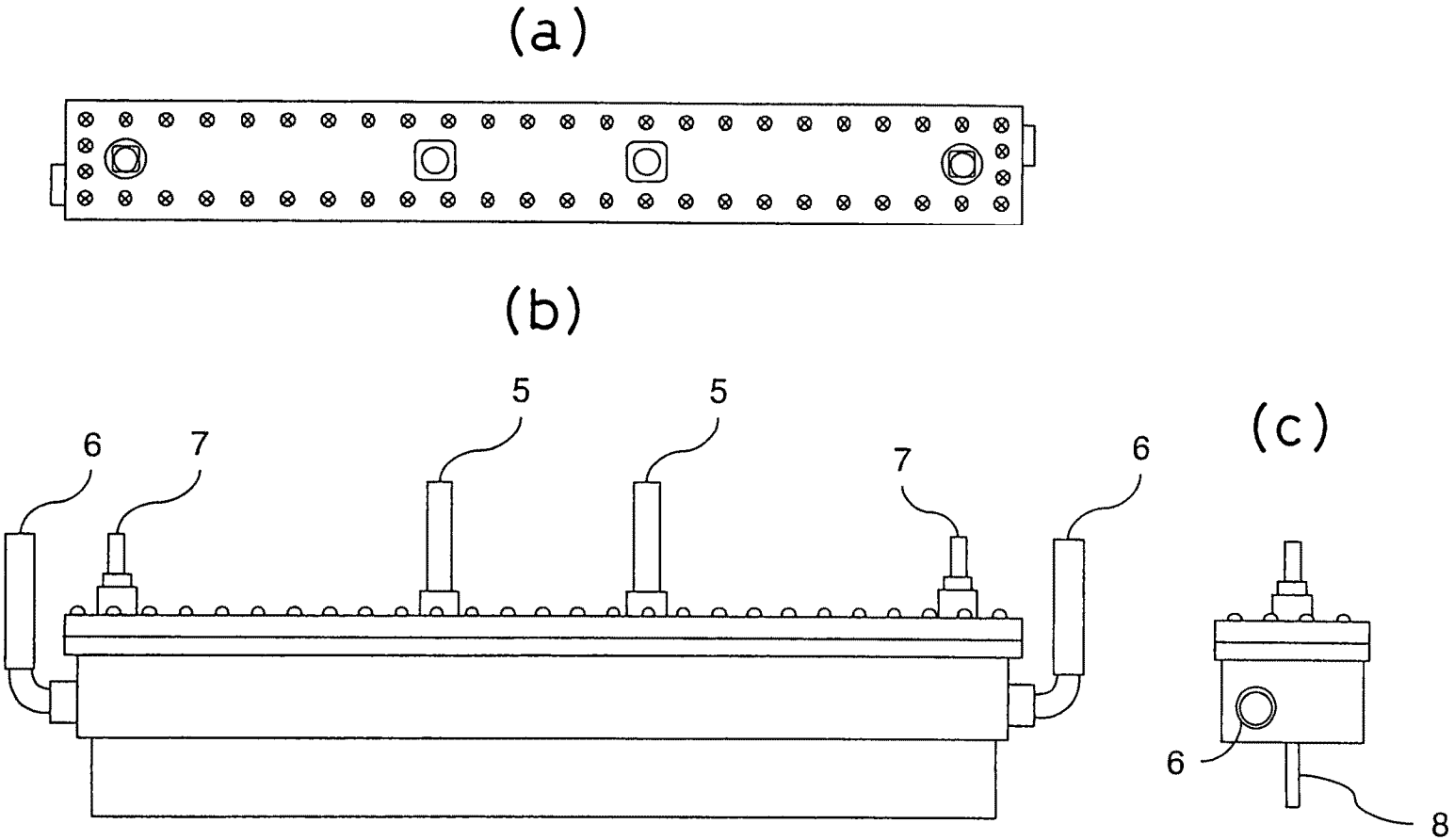
FIG. 3 are schematic views showing an example of a feeder of a cleaning solution activated by megasonic waves, wherein (a) is a top view, (b) is a front view, and (c) is a side view.
Figure 4:
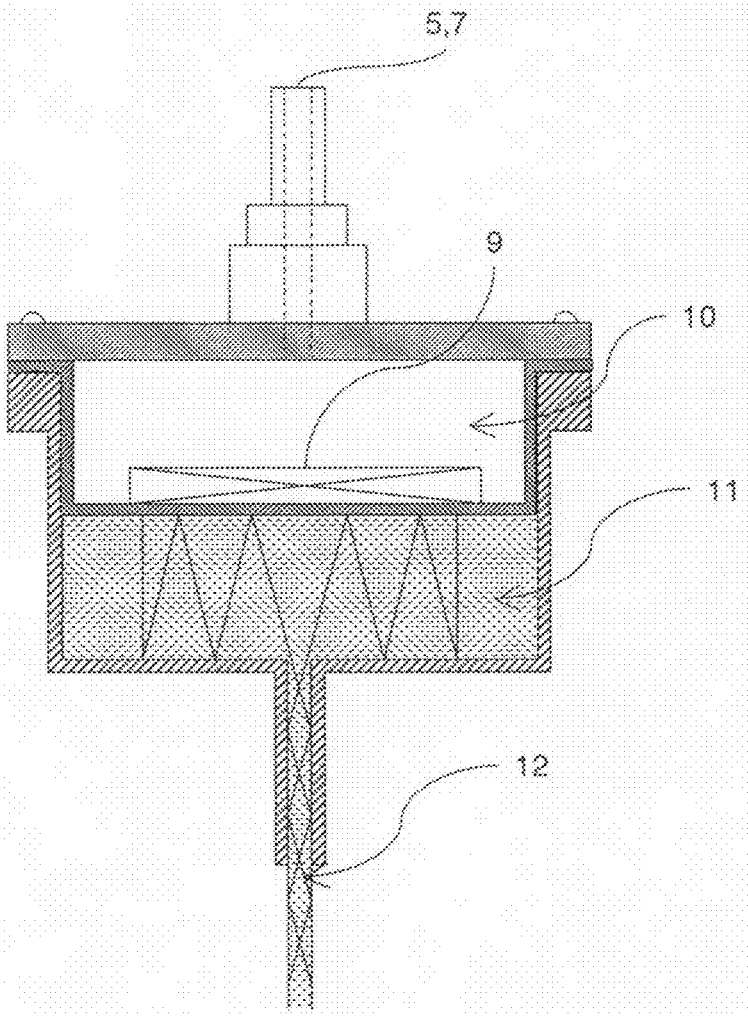
FIG. 4 is across-sectional schematic view showing an example of the internal structure of a feeder of a cleaning solution activated by megasonic waves.

FIG. 3 shows one example of a feeder 13 of the cleaning solution activated by megasonic waves of the present invention. Further, FIG. 4 shows one example of the internal structure of said feeder. The cleaning solution enters from the inlet 6. Due to the megasonic generator 9, the cleaning solution 11 is activated by the megasonic waves, whereby the cleaning solution 12 activated by the megasonic waves exits from the outlet 8 and is fed to the surface of the steel sheet.

Further, the ultrasonic generator part has the megasonic generator 9 and the storage part and cavity 10 holding the same. As explained later, preferably the ultrasonic generator part is provided with a gas flow exit/inlet 7 which feeds and discharges dried air or inert gas to and from this cavity part and a cable 5 supplying electric power.

Figure 5:
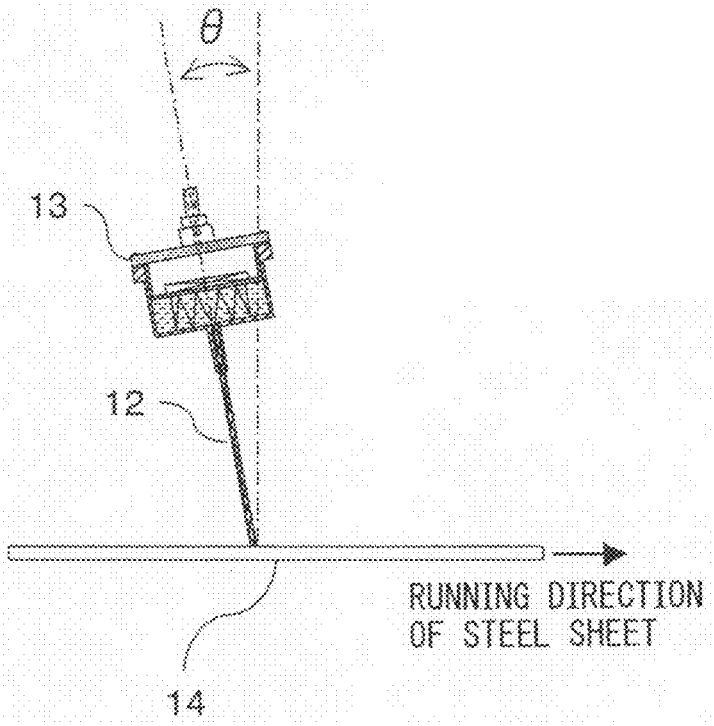
FIG. 5 is a view showing an example of feeding a cleaning solution activated by megasonic waves to horizontally running steel sheet.

FIG. 5 shows an example of feeding a cleaning solution 12 activated by megasonic waves of the present invention to horizontally running steel sheet 14. As explained below, the feed angle of said cleaning solution is inclined 1 to 80° with respect to the line vertical to the steel sheet surface in a direction opposite to the running direction of the steel sheet. This angle is designated as θ.

Figure 6:
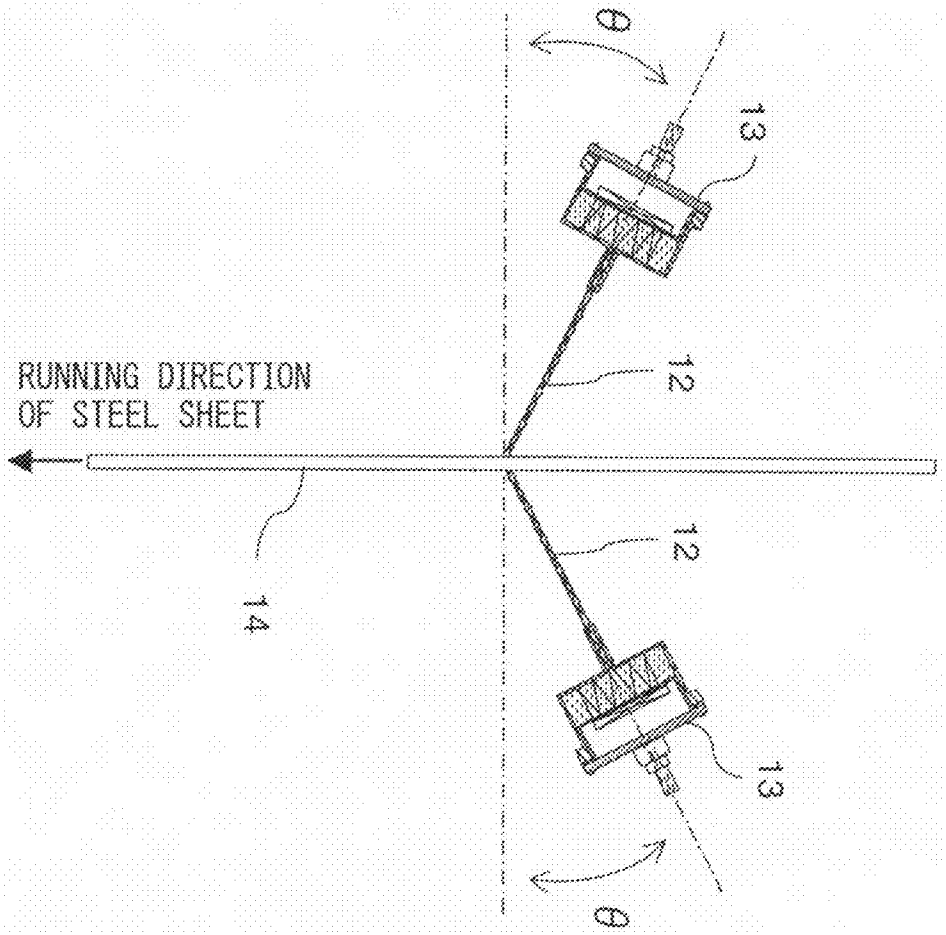
FIG. 6 is a view showing an example of feeding cleaning solution activated by megasonic waves to vertically running steel sheet.

Further, the vertically running steel sheet 14, as shown in FIG. 6, is fed the cleaning solution 12 activated by the megasonic waves. FIG. 6 is an example of feeding the solution to the both surfaces of the steel sheet, but it is also possible to feed it to only one side. The injection angle θ of said cleaning solution is, in the same way as above, inclined 1 to 80° with respect to the line vertical to the steel sheet surface in the direction opposite to the running direction.

If said angle θ is less than 1°, as explained below, the megasonic waves have a hard time reaching the bonding interface between the deposits and scale and the steel sheet surface, and a sufficient cleaning effect cannot be obtained. Further, for the above reasons, corrosion of the generator etc. by the cleaning solution easily occurs.

On the other hand, if the angle θ exceeds 80°, splattering of the cleaning solution is avoided, but the megasonic waves does not effectively reach the steel sheet surface (ultrasonic energy density becomes too low), and a sufficient cleaning effect cannot be obtained.

Said angle θ may be fixed or may be variable within said angle range or including outside said angle range. As a preferable angle range, a range of 10° to 80° is preferable economically, efficiency wise, and practically.

By making the feed angle of the cleaning solution be inclined in the opposite direction to the running direction of the steel sheet, the relative speed of the cleaning solution with respect to the steel sheet in the running direction of the steel sheet falls, so splattering of the cleaning solution is reduced.

Further, even if splattering, it splatters in the opposite direction to the ultrasonic generator, cables, etc. (steel sheet running direction), so will not directly strike these devices, so corrosion of the ultrasonic generator, cables, etc. can be suppressed and the maintainability of the facility is remarkably improved.

Furthermore, the cleaning solution striking the surface of the steel sheet flows over the surface of the steel sheet in the steel sheet running direction, so peeled off deposits and scale do not remain there, but are flushed away in the steel sheet running direction.

When spraying the cleaning solution, as is conventionally done, onto the oncoming steel sheet, the once peeled off deposits etc. are not immediately flushed away by the force of the cleaning solution, so may end up being again pushed into the surface of the steel material by the action of the highly directional powerful megasonic waves.

Therefore, the present invention may be used to improve the cleaning performance against deposits etc.

The feed rate of the cleaning solution is not particularly limited, but is preferably, per unit area of the steel sheet, 0.3 $L/m^2$ to 200 $L/m^2$. If less than 0.3 $L/m^2$, the problems arise that the ultrasonic waves cannot be conveyed etc. and a sufficient cleaning effect cannot be exhibited in some cases.

On the other hand, if over 200 $L/m^2$, the cleaning effect becomes higher, but a large amount of the cleaning solution becomes necessary, so this is not economical in some cases. The feed rate of the cleaning solution is more preferably 1 $L/m^2$ to 100 $L/m^2$. For example, if feeding the cleaning solution to the steel sheet running at a speed of 100 m/min by a 1 m width at a feed rate of the cleaning solution 1 $L/m^2$, the feed rate of the cleaning solution becomes 100 L/min.

At FIG. 5 and FIG. 6, the cleaning solution activated by the megasonic waves is fed at one side or both sides in one stage, but it is also possible to provide a plurality of feeders in the running direction of the steel sheet and feed the solution in multiple stages.

Further, at each stage, the type of cleaning solution can be changed. For example, it is possible to make the 1st to n-th a pickling solution and make the subsequent final stage (n+1), n+1 to n+2-th stage, or n+1 to n+3-th stage a rinse solution.

The ultrasonic waves used in the present invention have a frequency of 0.8 MHz to 3 MHz, i.e. megasonic. At said frequency band, unlike the conventional ultrasonic waves, the association of molecules or ions in the cleaning solution can be broken up and the movement of these molecules and ions can be made more active.

As a result, the cleaning effect is improved by the breakdown of the dirt on the surface of the steel sheet and the strong action on the interface between the strongly deposited foreign matter and steel sheet surface.

This is also effective for descaling. The following is believed. While differing depending on the atmosphere of the production process, heat treatment temperature, and additive elements and impurities included in the steel material, there are roughly three types of oxidized scale.

Specifically, these are FeO, $Fe_2O_3$, and $Fe_3O_4$. The surface of a steel material surface has magnetite ($Fe_3O_4$), the main ingredient of oxidized scale and slow in dissolution speed in a pickling solution, and hematite ($Fe_2O_3$), extremely slow in dissolution speed in a pickling solution, present on it.

By using the 0.8 MHz to 3 MHz frequency ultrasonic waves (megasonic waves) of the present invention, it is possible to activate the ingredients able to be dissolved in the pickling solution for the oxidized scale and efficiently make them react with the oxidized scale.

Further, by using these megasonic waves, the cleaned object or etched object can be locally given pressure by sound pressure. Due to this, the cleaned object and etched object may also be mechanically destroyed. As a result, the dissolution speed of the oxidized scale is improved.

If the ultrasonic waves have a frequency of less than 0.8 MHz, an effect cannot be obtained more sufficiently than conventional with said cleaning or descaling. On the other hand, if over 3 MHz, the cleaned object is given damage and a flat surface can no longer be obtained. As the frequency of the ultrasonic waves, a frequency of 0.8 to 1.5 MHz is more preferable.

In the present invention, the megasonic waves may be applied continuously or intermittently. Further, a plurality of frequencies of the megasonic waves may be used in combination within the range of frequency of the present invention. Further, joint use of the conventional ultrasonic waves and the megasonic waves of the present invention is also possible.

As the cleaning solution of the present invention, a conventional cleaning solution used for cleaning steel sheet may be used. For example, there may be an acidic solution, alkaline solution, neutral solution, or other cleaning solution. An acidic solution is, as a pickling solution, a hydrochloric acid solution, sulfuric acid solution, fluoric acid solution (hydrofluoric acid), or these solutions including nitric acid, acetic acid, formic acid, etc.

The pickling solution is used for cleaning of general steel sheet and also is used for removal of oxidized scale of hot rolled steel sheet. The alkaline solution is, for example, a solution containing caustic soda (NaOH) or caustic potash (KOH) etc. and is used for degreasing and other cleaning of steel sheet.

Further, the neutral solution is, for example, used as a rinse after said acid cleaning or alkali cleaning. The temperature of the cleaning solution is not particularly limited, but is more preferably from ordinary temperature to 80° C. for the reason of cleaning efficiency, temperature control, etc.

The running speed of the steel sheet in the cleaning unit of the present invention is preferably 300 m/min or less. If over 300 m/min, the irradiation time of the ultrasonic waves per unit time becomes_ shorter and a sufficient cleaning effect cannot be obtained in some cases. Said running speed is particularly preferably 20 m/min to 100 m/min. If less than 20 m/min, the production efficiency will drop in some cases.

When the running speed of the steel sheet is slow (50 m/min or less), there is also the effect of accelerating the flow of the solution on the surface, so it is preferable to make the angle θ1 to 29°. On the other hand, when the processing speed is fast (200 m/min or more), it is preferable to make the angle θ46 to 70°.

The method of the present invention is not dependent on the type of the steel sheet. Furthermore, it is effective for cleaning of 5 μm to 800 μm stainless steel foil. In particular, it is effective in types of steel sheet from which conventionally oxidized scale has been hard to remove, that is, steel sheet to which Ti, Nb, or Si is added.

The larger the output of the megasonic waves, the more effective. Since this involves additional facilities etc., this may be designed in accordance with the process of production of steel sheet. It is possible to handle this by the fabrication of a giant facility, but similar effects can be exhibited even if arranging a plurality of megasonic generators in parallel.

The method of spraying the cleaning solution of the present invention is not a particular issue, but a shower system or curtain flow system is general. A "shower system" means a system of a type having holes of a size of a diameter of about 10 mm to several 10's of mm or so and spraying the cleaning solution from these holes.

Further, a "curtain flow system" means a system having a slit of a width of about several mm to several cm and spraying the cleaning solution like a curtain from the slit.

The continuous cleaning system of steel sheet of the present invention is provided with at least an uncoiler 15, cleaning unit 19, and coiler 24. Said cleaning unit feeds a cleaning solution activated by 0.8 MHz to 3 MHz frequency ultrasonic waves (megasonic waves) by a shower system or curtain flow system to the surface of the steel sheet. The feed angle of said cleaning solution is inclined by 1 to 80° with respect to the line perpendicular to the steel sheet surface opposite to the running direction.

Said continuous cleaning system of steel sheet may furthermore be provided with an inlet side looper 17, an exit side looper 22, shearing machine, welder 16, tension leveler 18, oil coater 23, cleaning solution receiving container 20, etc. Further, when said cleaning unit is pickling or alkali cleaning, it is also possible to provide a rinse tank 21. Furthermore, this may also be jointly used as a pickling tank or alkali cleaning tank.

Figure 7:
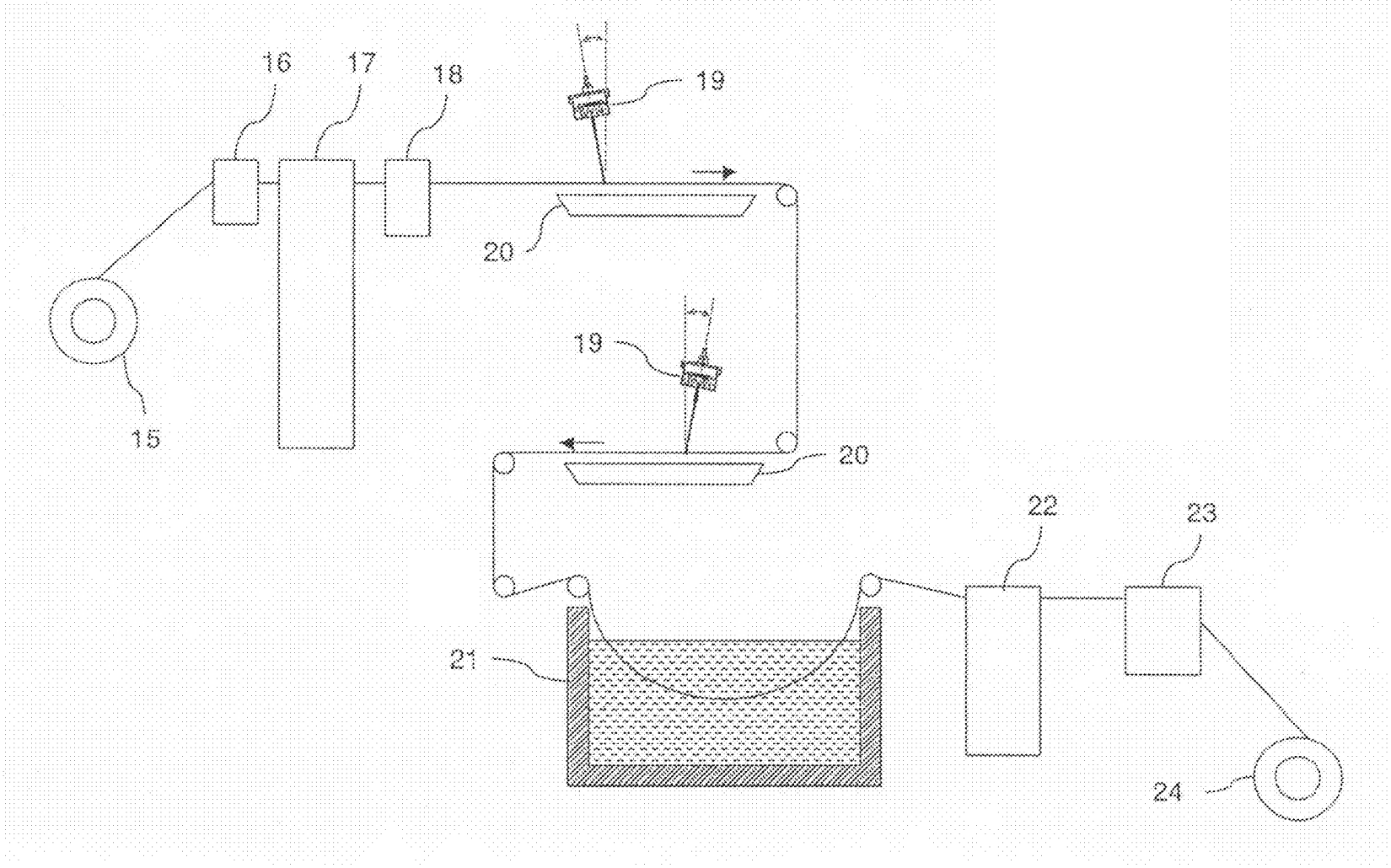
FIG. 7 is a schematic view showing a cleaner, that is, an example of a continuous cleaning system of steel sheet in the case where the steel sheet runs horizontally.
Figure 8:
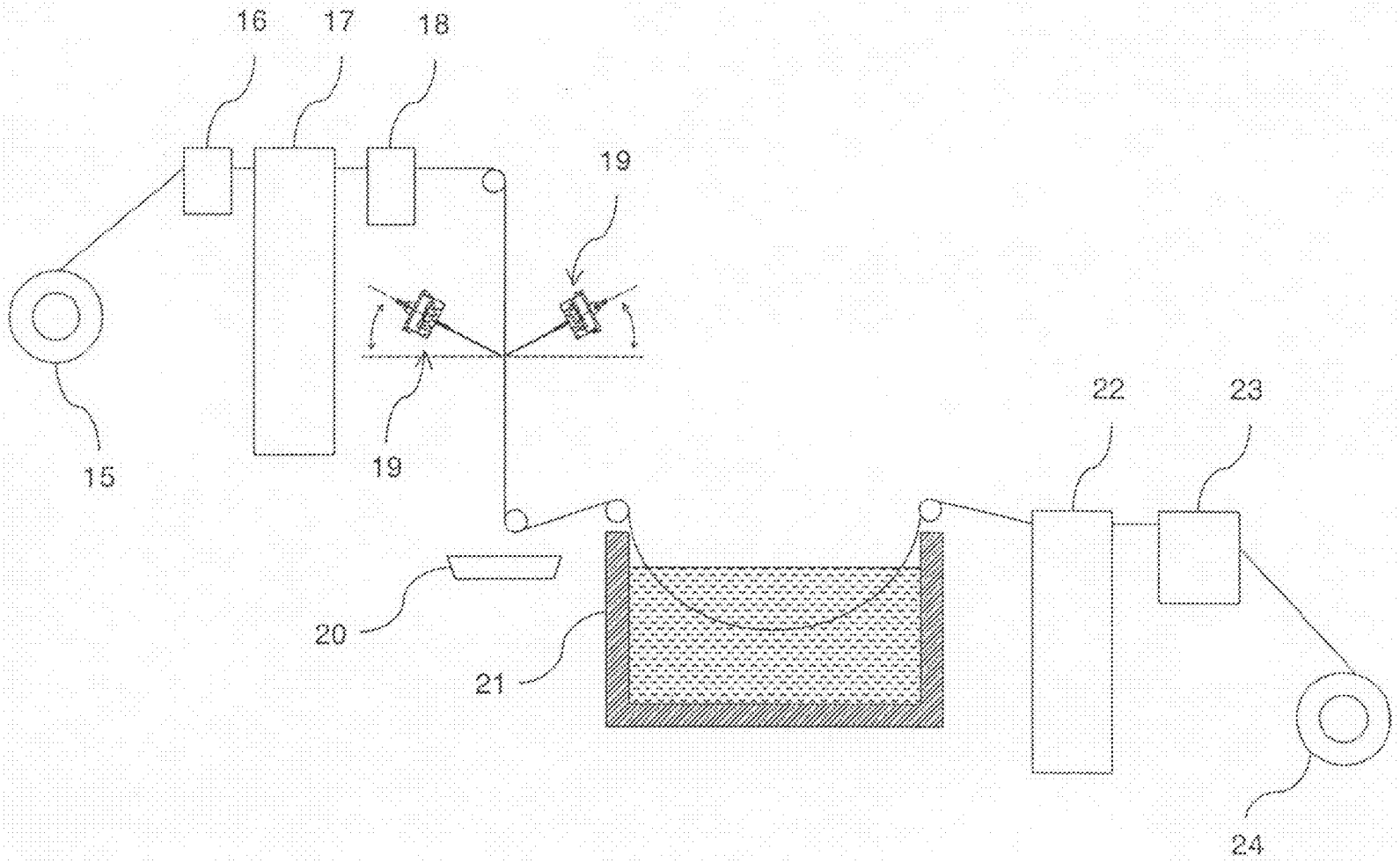
FIG. 8 is a schematic view showing a cleaner, that is, an example of a continuous cleaning system of steel sheet in the case where the steel sheet runs vertically.

FIG. 7 and FIG. 8 show examples of the continuous cleaning system pf steel sheet of the present invention. FIG. 7 is an example of a cleaning system in the case where the steel sheet runs horizontally. For cleaning both surfaces of the steel sheet, this is provided with cleaning units (feeders of cleaning solution activated by megasonic waves) 19 at two locations.

FIG. 8 is an example of a cleaning system in the case where the steel sheet is vertically running. To clean both surfaces of the steel sheet, the cleaning solution activated by megasonic waves is fed from both sides. The rinse in the example of two systems is fed from the rinse tank 21, but this system may also be configured to feed the rinse solution in the same way as the cleaning unit 19.

Further, the cavity part 10 in which the megasonic generator of FIG. 1, showing the details of said cleaning unit 19, is housed may be flushed with dried air or nitrogen, argon, helium, carbon dioxide gas, or another inert gas. By flushing it with said gas, it is possible to prevent the entry of the cleaning solution mist or HCl gas or other corrosion products and possible to better improve the durability.

EMBODIMENTS

Below, the present invention will be explained more concretely using examples, but the present invention is not limited by these examples in any way.

Example 1

As the steel material to be cleaned, stainless steel sheet was used. To evaluate the removal of foreign matter, the surface of the steel sheet was coated with polystyrene latex (PSL) standard particles (0.1 μm, 0.35 μm, 0.5 μm, 1 μm, and 2 μm) made by JSR Corp. and dried to obtain steel sheet with quasi-particles. The steel sheet was used to evaluate the removal performance of the deposited particles.

The feeder of a cleaning solution activated by ultrasonic waves shown in FIGS. 3 and 4 was used as shown in FIG. 5 to feed the cleaning solution to the surface of steel sheet running at a speed of 80 m/min. The ultrasonic wave frequency and the feed angle θ of FIG. 5 were changed to investigate the cleaning effect under different conditions.

The cleaning solution was fed by a 1 m wide shower system to give a discharge rate of 100 L/min, while the cleaning solution feed rate was made 1.25 L/m$^2$. Table 1 shows the frequency of the ultrasonic waves, the feed angle θ of the cleaning solution, and the cleaning effect. Examples 1-28 to 30 of Table 1 were performed by a curtain flow system under the same conditions as above.

For the cleaning solution, a pickling solution, alkaline cleaning solution, and rinse solution were used. The pickling solution was prepared as follows.

The HCl-based solution was made a 5 mass % HCl aqueous solution to which $FeCl_2$ and $FeCl_3$ were added in 0.1 mass %. The $H_2SO_4$-based solution was made a 5 mass % $H_2SO_4$ aqueous solution to which $FeCl_2$ and $FeCl_3$ were added in 0.1 mass %.

The alkali cleaning solution was made a typical alkali NaOH-based solution (caustic soda) comprised of a 1 wt % NaOH aqueous solution in which Fe ions were included in 0.1 mass %. For the rinse solution, pure water without any acid or alkali added was used.

Further, in the case of a pickling solution, the solution was warmed to and held at a temperature between 60° C. and 90° C. The alkali cleaning solution and rinse solution were held between room temperature and 40° C.

As the method of evaluation, the surface of the steel sheet was irradiated by 10000 lux or so strong light (called "optics collect light"), the state of the particles was sketched, then the residual particles were sketched under the focused beam lamp irradiation conditions. The removal rate was calculated to evaluate the removal rate of the particles on the surface.

The cleaning effect of Table 1 was judged in each case by preparing a sample not irradiated with ultrasonic waves and comparing it with the sample evaluated for the removal rate under the various types of conditions of Table 1. A sample with a ratio of improvement of the removal of less than 30% was labeled as "Poor", of 30% to less than 40% as "Fair", of 40% to less than 60% as "Good", and of 60% or more as "Very good". For part of the samples after removal of pseudo particles, the removed part was examined under an optical microscope or scan electron microscope to observe the state of the residual particles. As a result, particles of 0.2 μm or more could not be observed.

TABLE 1

| No. | Freq. (MHz) | Angle θ (°) | Cleaning solution | Cleaning effect | Remarks |
|---|---|---|---|---|---|
| 1-1 | 0.80 | 10 | HCl-based | Very good | Inv. ex. |
| 1-2 | 0.95 | 1 | HCl-based | Good | Inv. ex. |
| 1-3 | 0.95 | 28 | HCl-based | Very good | Inv. ex. |
| 1-4 | 0.80 | 38 | HCl-based | Very good | Inv. ex. |
| 1-5 | 0.95 | 80 | HCl-based | Very good | Inv. ex. |
| 1-6 | 0.95 | 46 | HCl-based | Very good | Inv. ex. |
| 1-7 | 0.95 | 52 | HCl-based | Very good | Inv. ex. |
| 1-8 | 0.95 | 58 | HCl-based | Very good | Inv. ex. |
| 1-9 | 0.95 | 62 | HCl-based | Very good | Inv. ex. |
| 1-10 | 0.95 | 60 | HCl-based | Very good | Inv. ex. |
| 1-11 | 0.95 | 30 | $H_2SO_4$-based | Very good | Inv. ex. |
| 1-12 | 0.95 | 10 | $H_2SO_4$-based | Very good | Inv. ex. |
| 1-13 | 0.95 | 10 | HCl-based | Very good | Inv. ex. |
| 1-14 | 3.0 | 30 | HCl-based | Very good | Inv. ex. |
| 1-15 | 2.0 | 30 | HCl-based | Very good | Inv. ex. |
| 1-16 | 0.95 | 80 | NaOH-based | Very good | Inv. ex. |
| 1-17 | 0.95 | 34 | NaOH-based | Very good | Inv. ex. |
| 1-18 | 0.95 | 10 | NaOH-based | Very good | Inv. ex. |
| 1-19 | 0.95 | 10 | Pure rinse solution | Good | Inv. ex. |
| 1-20 | 0.95 | 60 | Pure rinse solution | Good | Inv. ex. |
| 1-21 | 0.028 | 30 | HCl-based | Poor | Comp. ex. |
| 1-22 | 0.10 | 30 | HCl-based | Poor | Comp. ex. |
| 1-23 | 0.40 | 30 | HCl-based | Fair | Comp. ex. |

TABLE 1-continued

| No. | Freq. (MHz) | Angle θ (°) | Cleaning solution | Cleaning effect | Remarks |
|---|---|---|---|---|---|
| 1-24 | 0.60 | 30 | HCl-based | Poor | Comp. ex. |
| 1-25 | 0.95 | 0 | HCl-based | Fair | Comp. ex. |
| 1-26 | 0.95 | 85 | HCl-based | Poor | Comp. ex. |
| 1-27 | 3.5 | 30 | HCl-based | Substrate etched | Comp. ex. |
| 1-28 | 0.95 | 5 | $H_2SO_4$-based | Very good | Inv. ex. |
| 1-29 | 0.95 | 5 | HCl-based | Very good | Inv. ex. |
| 1-30 | 0.95 | 5 | Pure rinse solution | Good | Inv. ex. |
| 1-31 | 0.95 | −5 *1 | HCl-based | Poor Cleaning solution deposited on generator. Corrosion progressed. | Comp. ex. |

*1: Angles with a minus mark show slants in steel sheet running direction.

As shown in Examples 1-1 to 1-18, by feeding a cleaning solution comprised of an acidic or alkaline cleaning solution activated by ultrasonic wave frequency of 0.8 to 3 MHz by a feed angle θ of 1 to 80°, a high cleaning effect was shown.

As shown in Examples 1-19 to 1-20, even with a rinse solution, a sufficient cleaning effect could be obtained. As shown in Example 1-28 to 30, even with a curtain flow system, a sufficient cleaning effect could be obtained.

On the other hand, when the ultrasonic wave frequency was low as in Comparative Examples 1-21 to 22, a sufficient cleaning effect could not be obtained. When the ultrasonic wave frequency was too high as in Comparative Example No. 1-27, the polystyrene latex particles could be completely removed, but the surface of the stainless steel sheet of the substrate was seriously etched and a flat surface could not be obtained.

When feeding the cleaning solution activated by the ultrasonic wave vertically)(θ=0°) with respect to the steel sheet as in Comparative Example 1-25, a sufficient cleaning effect could not be obtained and splattered drops of the cleaning solution deposited on the cleaning solution feeder (ultrasonic generator).

When the feed angle θ of the cleaning solution activated by the ultrasonic wave was too large as in Comparative Example 1-26, a sufficient cleaning effect could not be obtained.

Comparative Example 1-31 shows the results when inclining the cleaning solution feeder to the steel sheet running direction side. It was confirmed that not only does the cleaning effect deteriorate, but also there is deposition of the cleaning solution on the generator, cables, etc. and corrosion progresses.

Example 2

As the steel material, a hot rolled plated with a slow oxidized scale dissolution speed was selected for use. The steel material was a steel sheet comprised of C: 0.002 wt %, Si: 0.006 wt %, Mn: 0.13 wt %, S: 0.01 wt %, Nb: 0.02 wt %, and Ti: 0.02 wt % and a balance of Fe and unavoidable impurities.

The feeder of a cleaning solution activated by ultrasonic waves shown in FIGS. 3 and 4 was used as shown in FIG. 6 and FIG. 8 to feed the cleaning solution to the surface of steel sheet running at a speed of 5 to 310 m/min. The ultrasonic wave frequency and the feed angle of FIG. 6 were changed in the range of Table 2 to investigate the descaling effect. The cleaning solution was fed by a 1 m wide shower system to give a discharge rate and cleaning solution feed rate as shown by Table 2.

The cleaning solution was fed by a shower system. As the pickling solution, HCl-based and $H_2SO_4$-based solutions were used. The HCl-based solution was comprised of an 8 mass % HCl aqueous solution to which $FeCl_2$ and $FeCl_3$ were added in amounts of 0.2 mass %. The $H_2SO_4$ based solution was comprised of a 10 mass % $H_2SO_4$ aqueous solution to which $FeCl_2$ and $FeCl_3$ were added in amounts of 0.2 mass %. The cleaning solution was warmed to a temperature of 70° C. (±10° C.)

As the evaluation method, the steel sheet was measured for mass in advance, treated by predetermined cleaning treatment under the conditions of Table 2, then was rinsed and dried then again measured for mass to calculate the amount of etching.

The evaluation was based on the dissolution speed of the surface scale. In each case, a sample not irradiated with ultrasonic waves in Table 2 was prepared and compared with a sample evaluated under the various conditions of Table 2 for judgment. A sample where the rate of improvement of the dissolution speed was less than 10% was expressed as "Poor", 10% to less than 20% as "Fair", 20% to less than 30% as "Good", and 30% or more as "Very good" when judging the cleaning effect.

Table 2 shows the results.

TABLE 2

| No. | Freq. (MHz) | Angle θ (°) | Solution | Processing rate (m/mim) | Cleaning solution discharge (L/min) | Cleaning solution feed (L/m$^2$) | Cleaning effect | Remarks |
|---|---|---|---|---|---|---|---|---|
| 2-1 | 0.95 | 30 | HCl-based | 100 | 20 | 0.2 | Good | Inv. ex. |
| 2-2 | 0.95 | 30 | HCl-based | 100 | 30 | 0.3 | Very good | Inv. ex. |
| 2-3 | 0.95 | 30 | HCl-based | 100 | 100 | 1.0 | Very good | Inv. ex. |
| 2-4 | 0.95 | 30 | HCl-based | 100 | 200 | 2.0 | Very good | Inv. ex. |
| 2-5 | 0.95 | 30 | HCl-based | 5 | 500 | 100 | Very good | Inv. ex. |
| 2-6 | 0.95 | 30 | HCl-based | 5 | 1000 | 200 | Very good | Inv. ex. |
| 2-7 | 0.95 | 30 | HCl-based | 5 | 1100 | 220 | Very good | Inv. ex. |
| 2-8 | 0.95 | 30 | HCl-based | 20 | 200 | 10 | Very good | Inv. ex. |
| 2-9 | 0.95 | 30 | HCl-based | 300 | 300 | 1.0 | Very good | Inv. ex. |
| 2-10 | 0.95 | 30 | HCl-based | 310 | 90 | 0.29 | Good | Inv. ex. |
| 2-10 | 0.8 | 30 | HCl-based | 80 | 160 | 2 | Very good | Inv. ex. |
| 2-11 | 0.95 | 30 | HCl-based | 80 | 160 | 2 | Very good | Inv. ex. |
| 2-12 | 0.95 | 30 | HCl-based | 160 | 160 | 1 | Very good | Inv. ex. |
| 2-13 | 0.95 | 30 | HCl-based | 120 | 160 | 1.33 | Very good | Inv. ex. |
| 2-14 | 0.95 | 30 | HCl-based | 40 | 160 | 4 | Very good | Inv. ex. |
| 2-15 | 0.95 | 80 | HCl-based | 80 | 160 | 2 | Good | Inv. ex. |
| 2-16 | 0.95 | 75 | HCl-based | 80 | 160 | 2 | Very good | Inv. ex. |
| 2-17 | 0.95 | 60 | HCl-based | 80 | 160 | 2 | Very good | Inv. ex. |
| 2-18 | 0.95 | 32 | HCl-based | 80 | 160 | 2 | Very good | Inv. ex. |
| 2-19 | 0.95 | 1 | HCl-based | 80 | 160 | 2 | Good | Inv. ex. |
| 2-20 | 0.95 | 30 | $H_2SO_4$-based | 80 | 160 | 2 | Very good | Inv. ex. |
| 2-21 | 0.95 | 60 | $H_2SO_4$-based | 60 | 160 | 2 | Very good | Inv. ex. |
| 2-22 | 2.0 | 30 | HCl-based | 80 | 160 | 2 | Very good | Inv. ex. |
| 2-23 | 3.0 | 30 | HCl-based | 80 | 160 | 2 | Very good | Inv. ex. |
| 2-24 | 1.5 | 30 | HCl-based | 80 | 160 | 2 | Very good | Inv. ex. |
| 2-25 | 2.0 | 30 | HCl-based | 80 | 160 | 2 | Very good | Inv. ex. |
| 2-26 | 0.028 | 30 | HCl-based | 80 | 160 | 2 | Poor | Comp. ex. |
| 2-27 | 0.1 | 30 | HCl-based | 80 | 160 | 2 | Poor | Comp. ex. |
| 2-28 | 0.4 | 30 | HCl-based | 80 | 160 | 2 | Fair | Comp. ex. |
| 2-29 | 0.95 | 0 | HCl-based | 80 | 160 | 2 | Fair | Comp. ex. |
| 2-30 | 0.95 | 85 | HCl-based | 80 | 160 | 2 | Poor | Comp. ex. |
| 2-31 | 3.5 | 30 | HCl-based | 80 | 160 | 2 | Substrate etching | Comp. ex. |
| 2-32 | 0.95 | −30 *1 | HCl-based | 80 | 160 | 2 | Poor Cleaning solution deposits on generator leading to corrosion | Comp. ex. |

*1: Angles with a minus mark show slants in steel sheet running direction.

When the ultrasonic wave frequency is in the range of 0.8 to 3 MHz and the feed angle θ of the cleaning solution is 1 to 80 as in Example Nos. 2-1 to 2-25 of the present invention, the pickling speed become greater and as a result the cleaning effect become greater.

Further, no situation where the quality of the surface of the steel material is damaged after pickling could be recognized. In particular, with a feed rate of the cleaning solution of 0.3 L/m$^2$ or more, the cleaning effect became larger.

Furthermore, if feeding the cleaning solution activated by ultrasonic waves in two stages, the cleaning effect was higher and more efficient.

As opposed to this, when the ultrasonic wave frequency was low as in Comparative Example Nos. 2-26 to 2-28, the dissolution speed of the oxidized scale was slow, and the oxidized scale could not be completely removed or spots occurred at different locations.

When the ultrasonic wave frequency was too high as in Comparative Example No. 1-31, the oxidized scale could be completely removed, but the surface of the stainless steel sheet of the substrate was seriously etched and a flat surface could not be obtained.

Further, when the cleaning solution activated by ultrasonic wave was fed vertically)(θ=0°) with respect to the steel sheet as in Comparative Example No. 2-29, a sufficient cleaning effect could not be obtained and splattered drops of the cleaning solution deposited on the cleaning solution feeder (ultrasonic generator).

When the feed angle θ of the cleaning solution activated by ultrasonic wave was too large as in Comparative Example 2-30, a sufficient cleaning effect could not be obtained.

Comparative Example 2-32 shows the results of inclining the cleaning solution feeder to the steel sheet running direction side. It was confirmed that not only does the cleaning effect deteriorate, but also there is deposition of the cleaning solution on the generator, cables, etc. and corrosion progresses.

Example 3

A similar method to Example 2-11 was used to run dried air or nitrogen through a cavity in which an ultrasonic generator was housed (cavity 10 of FIG. 4) and perform continuous pickling for 100 hours. After this, the chlorine present in said cavity or extent of corrosion was investigated. The method of evaluation of the cleaning effect was similar to Example 2.

Table 3 shows the results. As shown in Example Nos. 3-1 and 3-2, by flushing dried air or nitrogen through the generator part, the entry of chlorine or other corrosive substances can be effectively prevented.

TABLE 3

| No. | Inflow of gas at generator part | Cleaning effect | Corrosion of generator part etc. | Remarks |
|---|---|---|---|---|
| 3-1 | Dried air | Very good | No corrosion | Inv. ex. |
| 3-2 | Nitrogen | Very good | No corrosion | Inv. ex. |
| 3-3 | None | Very good | Trace of fine amount of chlorine, but no corrosion | Inv. ex. |

INDUSTRIAL APPLICABILITY

According to the method of cleaning steel sheet and continuous cleaning system of steel sheet of the present invention, even if apply megasonic waves for the continuous cleaning of steel sheet, it is possible to suppress corrosion of the apparatus, so the maintainability of the facility can be improved.

Furthermore, the remarkable action and effect are exhibited that the cleaning effect and cleaning speed of the steel sheet are improved, the cleaning efficiency can be improved, and the cleanliness of the surface of the steel sheet after cleaning is superior. Furthermore, this is also effective for removal of oxidized scale from hot rolled steel sheet. The extremely remarkable action and effect are exhibited of improvement of the efficiency of descaling and the ability to form a clean surface free of descaling scars.

Therefore, the present invention has extremely high applicability in the iron and steel industry.

The invention claimed is:

1. A method of cleaning a steel sheet, wherein said steel sheet is running in a running direction, said method of cleaning said steel sheet is conducted by using a continuous cleaning system characterized in that a cleaning unit consists of a cleaning solution feeder and a rinse unit, said method of cleaning said steel sheet comprising spraying a cleaning solution activated by megasonic waves of a frequency of 0.8 MHz to 3 MHz to a surface of said steel sheet at a feed angle inclined in a direction opposite to the running direction by 10-52° with respect to a line perpendicular to the surface of the steel sheet and spraying said surface in the running direction such that said cleaning solution with said megasonic waves strikes said surface, flows over said surface in the running direction and is received in a cleaning solution receiving container, thereby cleaning said steel sheet, wherein a running speed of the steel sheet is in the range of 20 to 300 m/min and a discharge rate of the cleaning solution is in the range of 200 to 1100 L/min wherein the steel sheet is not immersed in the cleaning solution, and wherein a feed rate of the cleaning solution is, per unit area of the steel sheet, in a range of 1 $L/m^2$ to 200 $L/m^2$, wherein a storage part of the cleaning solution feeder, an outlet of the cleaning solution feeder and a cavity part of the cleaning solution feeder in which a megasonic generator to generate the megasonic waves is housed are inclined at the feed angle of the cleaning solution, and wherein the cavity part is flushed with dried air or inert gas to prevent an entry of corrosion products.

2. The method of cleaning the steel sheet as set forth in claim 1, wherein said cleaning solution is sprayed to the surface of the steel sheet by a shower system or a curtain flow system.

3. The method of cleaning the steel sheet as set forth in claim 1, wherein said cleaning solution is a pickling solution.

4. The method of cleaning the steel sheet as set forth in claim 1, wherein said steel sheet is a hot rolled steel sheet, said cleaning solution is a pickling solution, and oxidized scale of said hot rolled steel sheet is removed.

5. The method of cleaning the steel sheet as set forth in claim 1, wherein the megasonic waves are of a frequency of 0.8 MHz to 1.5 MHz.

* * * * *